United States Patent [19]

Geissler et al.

[11] 4,035,161

[45] July 12, 1977

[54] GRINDING WHEEL AND HUB AND METHOD OF FORMING THE SAME

[75] Inventors: Ernst Geissler, Schwaz; Wilheim Haidacher; Heinrich Ofer, both of Vomp, all of Austria

[73] Assignee: Tyrolit-Schleifmittelwerke Swarovski K.G., Schwaz, Austria

[21] Appl. No.: 646,595

[22] Filed: Jan. 5, 1976

Related U.S. Application Data

[63] Continuation-in-part of Ser. No. 448,753, March 6, 1974, abandoned.

[51] Int. Cl.[2] ..... C08J 5/14

[52] U.S. Cl. ..... 51/296; 51/298 A; 51/308; 51/309 R

[58] Field of Search ..... 51/296, 298, 295, 448, 51/753, 308, 309

[56] References Cited

U.S. PATENT DOCUMENTS

| | | | |
|---|---|---|---|
| 3,364,630 | 1/1968 | Rusk et al. | 51/298 |
| 3,529,945 | 9/1970 | Charvat | 51/296 |
| 3,800,483 | 4/1974 | Sherman | 51/298 |
| 3,960,516 | 6/1976 | Biardi | 51/293 |

*Primary Examiner*—Donald J. Arnold
*Attorney, Agent, or Firm*—Wenderoth, Lind & Ponack

[57] ABSTRACT

An abrasive body is formed with a center bore therethrough. A molding ring is placed within the center bore to define an annular space. A foamed plastic such as polyurethane is supplied to the space and when the foamed plastic sets there results a rigid and dense hub for the abrasive body. A portion of the plastic foams into the inner wall of the abrasive body.

6 Claims, 2 Drawing Figures

GRINDING WHEEL AND HUB AND METHOD OF FORMING THE SAME

This is a continuation-in-part of application Ser. No. 448,753, filed Mar. 6, 1974, now abandoned.

BACKGROUND OF THE INVENTION

The present invention relates to the production of a grinding wheel or a rotary abrasive element including an abrasive body made of granular abrasive material, of a binder and preferably of an active and an inactive filler. One of the essential properties required of such a grinding wheel is that it be accurately centered so as to avoid any imbalance during operation.

According to the hitherto known methods for manufacturing grinding wheels the abrasive material, consisting of the actual abrasive, for instance corundum, of a binder and of active and inactive fillers, is put into molds, compressed and burnt in a furnace.

It becomes apparent from the above that the location of the bore which is particularly important for the running of the wheel is determined at a moment when the treatment of the wheel is not yet finished. This is a considerable shortcoming inasmuch as the subsequent treatment of the untreated and sensitive wheel or abrasive body, as well as the burning process thereof, may cause a deformation or warping of the wheel.

According to the present state of the art the hub of wheels, particularly of wheels with large diameters, is formed mechanically after the wheel is finished, i.e. after the cooling of the binder.

However, this operation results in a considerable loss of granular material, since it can only be performed by removing some of the material. Further, this operation takes a long time.

The injection of a synthetic hub has proved impracticable in the case of wheels with large diameters or great volumes, for instance with bores having a diameter of 100 mm or more and depths of more than 50 mm, since the synthetic material employed cools too rapidly during the injection.

High-pressure injection cannot be employed for porous wheels, since such injection causes considerable cracking of the wheel.

SUMMARY OF THE INVENTION

It is therefore an object of the present invention to create a grinding wheel or a rotary abrasive element, the hub of which is smooth and exactly centric, no expensive subsequent treatment of the wheel being however required.

This object is achieved according to the invention by the provision of a hub formed of a foamed plastic, for instance polyurethane plastic.

The method for manufacturing a grinding wheel or a rotary abrasive wheel of the above type is characterized in that the hub is obtained by molding of the foam after the binder in the abrasive wheel has hardenecd.

The supplying of the foam is preferably performed in that a molding ring is inserted into the hub area of the grinding wheel, the outside diameter of the molding ring corresponding to the inside diameter of the to be formed hub. The space formed by the molding ring and the inside area of the grinding wheel can be filled by the foam formed in a known manner.

BRIEF DESCRIPTION OF THE DRAWINGS

The invention will hereinafter be described in detail with reference to the figures of the attached drawings without being limited to the embodiment therein illustrated.

DETAILED DESCRIPTION OF THE INVENTION

Figure 1:
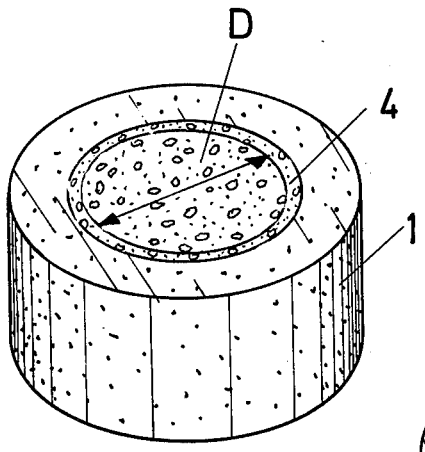
FIG. 1 is a perspective view of an example of an abrasive element according to the invention.
Figure 2:
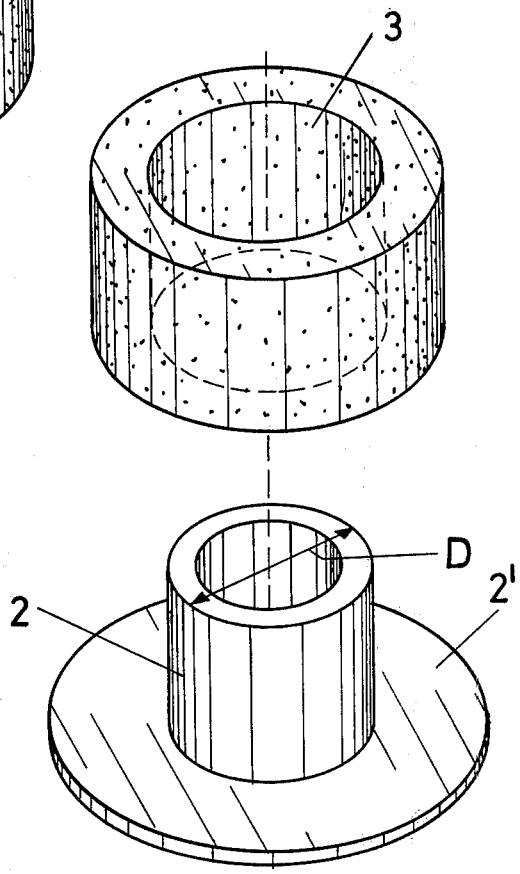
FIG. 2 is a perspective schematic representation of an abrasive body and of a molding ring.

The actual abrasive body 1 is mixed, molded and burnt in a furnace in a conventional manner.

It is to be specifically understood that the present invention is directed to the formation of a foamed plastic hub in a center opening in a grinding wheel of the type which is solid and is made from conventional granular abrasive materials, conventional binders, and conventional fillers. It is to be further specifically understood however that the present invention is not directed to the specific abrasive material, binders and fillers. These components are well known to those of ordinary skill in the art, and it is considered to be within the scope of the present invention to employ abrasive grinding wheels formed by any known and conventional combination of abrasive materials, binders and fillers.

Exemplary conventional grinding materials are corundum, and specifically white or friable aluminum oxide, semi-friable aluminum oxide or conventional aluminum oxide. Additionally, silicon carbide, zirconic corundum, boron carbide, nitrides, borides, diamond or the like may be employed. However, it is again specifically emphasized that other conventional abrasive materials which are known to be employed in the manufacture of abasive grinding wheels may be employed.

Exemplary binders which may be employed are resin binders such as phenol resin and vitrified binders which are conventionally a mixture of feldspar, clay, kaolin and metallic oxides. It is again emphasized however that other conventional binders which are normally used in the manufacture of abrasive grinding wheels may be employed.

Inactive fillers are well known in the art and are employed for purposes such as reducing the necessary amount of binder, reinforcing the grinding element (by means such as glass fiber or asbestos) and controlling the abrasive character of the abrasive element. It is specifically to be understood that any conventional such inactive filliers may be employed.

Active fillers are those which employ a chemical or physical reaction, and many such active fillers are known by those in the art. Exemplary of active fillers are organic or inorganic bonds which contain highly reactive elements. For instance, sulphur, metallic sulphides and metallic halides are known active fillers. It is however specifically to be understood that other conventional active fillers known to be employable in the manufacture of abrasive grinding wheels may be used.

Furthermore, it is specifically pointed out that the quantities of proportions of the above materials employed to form a specific abrasive grinding wheel is not in and of itself part of the present invention. Rather, the concept of the present invention is intended to be employed with any conventional abrasive grinding wheel formed in conventional processes and including conventional and known abrasive materials, binders and fillers.

After the binder has cooled, i.e. after the actual completion of the manufacture of abrasive body 1, the latter is mounted onto a molding ring 2.

The outside diameter D of molding ring 2 corresponds to the inside diameter of the hub to be formed by the supply of foamed plastic.

Whereas upon the previous manufacture of abrasive body 1 it was not necessary to pay particular attention to accurately center bore 3 of the wheel, this requirement is absolutely essential upon the mounting of abrasive body 1 onto molding ring 2.

In the example shown, molding ring 2 is provided with a lower core plate 2'.

After abrasive body 1 has been mounted onto molding ring 2 and has been accurately centered, the gap or space formed between molding ring 2 and abrasive body 1 is filled in any known and conventional manner with foamed plastic, for instance polyurethane plastic. When the formed plastic cures or sets, abrasive body 1 thereby is provided with a hub 4.

The advantages of the method according to the invention reside in that the supplying or injection of the foam can be carried out rapidly, and that losses of the granulated material due to heretofore necessary subsequent treatment of the bore of the abrasive body itself are avoided.

A further essential advantage of the invention is that upon the injection of the foam the hub area or inner surface of the abrasive wheel is impregnated with the two component liquid of the foamed plastic, and the bursting value of the wheel thereby is increased by 5 to 20% in comparison with a conventional wheel.

This effect is particularly surprising inasmuch as the foamed plastic, particularly polyurethane plastic, forms a dense marginal zone towards the inner portion of the hub, such zone representing an additional protection against damage.

It is to be understood that it is considered to be within the scope of the present invention to form the hub 4 by any conventional foamed plastic material which will result in a hub 4 having the obvious necessary properties of being rigid and dense and being resistant to heat generated during subsequent use of the abrasive wheel. More particularly, it is not intended to limit the scope of the present invention to the use of any particular or specific foamed plastic material.

However, it is particularly contemplated that the foamed plastic material be a polyurethane plastic formed by a mixture of a polyisocyanate, a polyol and a motive substance such as a difluoro-dichloro/methane. Any conventional such substances known by those skilled in the art may be employed.

The polyol and polyisocyanate are poured into the mold with the motive substance, and polyurethane is produced. The polyurethane mixture may be cured under a pressure of from three to four atmospheres at a temperature of for instance from 130° to 140° C. for a time of for instance seven minutes.

The resultant polyurethane material forming the hub 4 desirably has a volumetric weight of from 300 to 800 kg/m$^3$, a tensile strength of from 94 to 315 kp/cm$^2$, a bending strength of from 215 to 515 kp/cm$^2$, a crushing strength at 20° C. of 89 to 250 kp/cm$^2$, a Shore hardness after a waiting period of 24 hours of from 63 to 77, and a temperature stability of approximately 90° C.

EXAMPLE

In a specific example of carrying out the present invention polyisocyanate and polyol were mixed in a proportion of 10/11 and a motive substance to produce gas was added thereto to produce a mixture having a viscosity of 1700 cp. This mixture was poured into the molding space formed between molding ring 2 and the inner bore surface of abrasive body 1 to produce polyurethane which was cured at a pressure of from between three to four atmospheres and at a temperature between 130° to 140° C. for seven minutes. A portion of the polyurethane foamed into the inner bore surface of the abrasive wheel 1. After being cured and after a waiting period of 24 hours, the hub 4 was determined to have a volumetric weight of 600 kg/m$^3$, a tensile strength of 195 kp/cm$^2$, a bending strength of 415 kp/cm$^2$, a crushing strength at 20° C. of 195 kp/cm$^2$, a Shore hardness of 75, and a temperature stability of 90° C.

It is however pointed out that the scope of the present invention is not limited to the use of the above specifically described polyurethane material. Furthermore, the scope of the present invention is not limited to the above specific exemplified method of formation of the foamed plastic material. Rather, the scope of the present invention is only limited to the formation in the center bore of a solid abrasive grinding wheel formed of conventional abrasive materials, binders and fillers of a hub formed of a foamed plastic material provided and molded by conventional and known processing techniques.

It will be apparent that various modifications to the above specifically defined features may be made without departing from the scope of the present invention.

What is claimed is:

1. A grinding wheel or rotary abrasive element comprising:

an annular, solid, integral, cured abrasive body made of inorganic abrasive material, a binder and fillers, said body having an outer annular abrasive surface and an inner annular abrasive surface, said inner abrasive surface being spaced radially inwardly from said outer abrasive surface and defining a center bore through said body; and a dense and rigid cylindrical hub formed of foamed plastic material rigidly fixed within said center bore of said abrasive body, said foamed plastic of said hub being foamed into said inner abrasive surface of said center bore of said abrasive body.

2. A method of manufacturing a grinding wheel or a rotary abrasive body, said method comprising:

forming an annular, solid, integral, cured abrasive body from inorganic abrasive material, a binder and fillers, such that said body has an outer annular abrasive surface and an inner annular abrasive surface, with said inner abrasive surface being spaced radially inwardly from said outer abrasive surface and defining a center bore through said body; and without any preliminary removal treatment of said inner abrasive surface of said abrasive body, forming a rigid hub within said center bore of said abrasive body by injecting therein foamed plastic material; said step of forming a hub comprising placing a molding ring through said center bore, thus forming a space between said molding ring and said inner abrasive surface of said center bore of said abrasive body, and injecting said formed plastic material into said space, said formed plastic material foaming into said inner abrasive surface of said center bore of said abrasive body.

3. A grinding wheel or abrasive element as claimed in claim 1, wherein said foamed plastic material is polyurethane plastic.

4. A grinding wheel or abrasive element as claimed in claim 1, wherein said abrasive body has a thickness of more than 55 mm.

5. A grinding wheel or abrasive element as claimed in claim 1, wherein said abrasive body has an outer diameter greater than said thickness.

6. A method as claimed in claim 2, wherein said foamed plastic material is polyurethane plastic. than 55 mm.

* * * * *